United States Patent [19]

Barthelmes

[11] 4,005,663

[45] Feb. 1, 1977

[54] BELT LOOP FORMING ATTACHMENT FOR SEWING MACHINE

[76] Inventor: Raymond Barthelmes, P.O. Box 602, Wurtsboro, N.Y. 12790

[22] Filed: Dec. 18, 1975

[21] Appl. No.: 641,913

[52] U.S. Cl. ..... 112/115; 112/104; 112/121.27; 112/252

[51] Int. Cl.[2] ..... D05B 3/00

[58] Field of Search ..... 112/115, 121.13, 121.27, 112/104, 2, 101, 265, 253, 252

[56] References Cited

UNITED STATES PATENTS

| | | | |
|---|---|---|---|
| 1,739,397 | 12/1929 | Johnson | 112/101 |
| 2,906,218 | 9/1959 | Minchenberg | 112/104 |
| 3,288,093 | 11/1966 | Warga | 112/104 |
| 3,599,588 | 8/1971 | Angele | 112/253 X |
| 3,841,247 | 10/1974 | Off et al. | 112/121.27 |

*Primary Examiner*—G. V. Larkin
*Attorney, Agent, or Firm*—Jack D. Slobod

[57] ABSTRACT

An attachment for automatically forming a horizontal thread loop over the sewing area of a sewing machine to enable the loop to be sewn onto a garment as a belt loop includes a prong mounted on one side of the sewing area. A solenoid driven linkage located on the other side of sewing area carries an eye which receives thread from a source. The free end of the thread, after passage through the eye is pinched initially between a fixed sleeve and a moving arrow-shaped blade carried for movement with a sliding bed plate of the machine and located on the other side of the sewing area. In response to brief energization of the solenoid, the eye is carried across the sewing area and about the prong to catch the thread thereon and thereby form a loop having two straight crossing segments radiating from the prong respectively to the eye and the sleeve. During the sewing cycle including forward and rearward movements of the bed plate relative to the vertically reciprocating sewing needle of the machine, the blade, in its forward travel releases the free end of the thread, and in its rearward travel carries the segment directed between the prong and the eye to the sleeve for cutting the segment and pinching the resultant free end of the thread.

4 Claims, 7 Drawing Figures

BELT LOOP FORMING ATTACHMENT FOR SEWING MACHINE

FIELD OF THE INVENTION

The present invention relates generally to belt loop forming and sewing apparatus. In its particular aspects, the present invention relates to apparatus for automatically forming a generally horizontally oriented thread loop over the bed of a sewing machine in a position intersecting the sewing path of the machine.

BACKGROUND OF THE INVENTION

Heretofore, thread belt loops have been formed and held by hand on top of a garment positioned on the sewing area of a sewing machine and the machine has been operated to sew or tack the loop to the garment. The forming of the thread loop by hand is relatively costly in terms of time consumption and produces variations in repeatability of loop size. Further, because a hand of the operator is usually placed close to the sewing path to position the thread loop, there is a danger of injury.

While semi-automatic apparatus has heretofore been proposed to form a thread belt loop as in U.S. Pat. No. 2,906,218 and 3,095,842, such apparatus has operated by passing a thread through a doubled over portion of the garment with a needle. After this operation the thread is cut and the opposite ends of the thread are manually tied together in a time consuming operation.

Further, apparatus for sewing belt loop ribbons onto garments, such as in U.S. Pat. No. 2,730,976 and 3,841,247 are not adaptable to the formation of thread belt loops and are disadvantages in requiring at least two spaced apart lines of stitching for fastening to a garment.

OBJECTS OF THE INVENTION

It is an object of the present invention to provide apparatus for automatically forming a loop of thread on the bed of a sewing machine in an orientation intersecting the sewing path of the machine in order that the machine may be utilized to sew the loop onto a garment.

It is a further object of the present invention to provide an attachment for a sewing machine which is adapted to automatically form a loop having two straight segments which cross proximate to the sewing path of the machine.

It is yet another object of the present invention to provide a thread belt loop forming attachment for a sewing machine which includes means for automatically holding the loop in position over the bed of the machine during its sewing cycle and means for automatically cutting the loop from a source of thread upon termination of the sewing cycle.

It is still another object of the present invention to provide a means for automatically initiating loop formation upon the bed of a sewing machine once a previously processed garment is removed from the bed.

SUMMARY OF THE INVENTION

Briefly, the aforementioned and other objects of the present invention are satisfied by providing an attachment for a sewing machine of the button hole sewing type. This type of sewing machine has a vertically reciprocating needle positioned over a sliding plate in the bed of the machine, which moves first forward and then backward along an elongated sewing path. The attachment includes a prong mounted on the sliding plate of the machine on one side of a needle receiving slot in the plate.

A linkage is provided carried on a stationary portion of the machine on the other side of the slot. The linkage includes a horizontally moveable arm having an eye at one end. A thread for the loop is directed from a spool through the eye via an air drag type thread tensioning means. The free end of the loop is held by being pinched initially between a blade, mounted for movement with the sliding plate, and a fixed sleeve through which the blade passes.

The linkage is driven by a motor means and is configured to move the eye along a teardrop shaped contour across the slot, around a rear side of the prong, to catch the thread on the prong, and then back to an initial position of the eye. The direction of movement of the eye about the prong is chosen to form the loop of two straight segments which cross generally at the center of the slot. One segment is directed between the eye and the prong and the other is directed between the prong and the sleeve.

During the sewing cycle the blade is translated forward and backward in a path parallel to that followed by the sliding plate. At the beginning of the forward travel, the blade leaves the sleeve and releases the free end of the thread. A rearwardly inclined front blunt edge of the blade projects the thread segments upwards over the blade during its forward movement. During the backward movement of the blade, a sharpened, generally vertical, rear edge thereof carries the thread segment directed between the eye and prong back to the sleeve, cuts this segment by coaction with the sleeve, and pinches the resultant free end of the thread between the blade and sleeve.

The linkage is driven by a motor means such as a linear actuator in response to the manual actuation of a switch. In order to automatically energize the motor means for causing a new loop to be formed when the old loop is removed from the bed of the machine, the prong may be mounted on a lever. The lever is spring biased with a torque opposite the moment caused by the tension of the loop. A microswitch means is positioned to sense movement of the lever caused by removal of the thread loop and to energize the motor means in response thereto.

Other objects, features and advantages of the present invention will become apparent upon perusal of the following detailed description of the preferred embodiments thereof when taken in conjunction with the appended drawing wherein.

DETAILED DESCRIPTION

Figure 1:
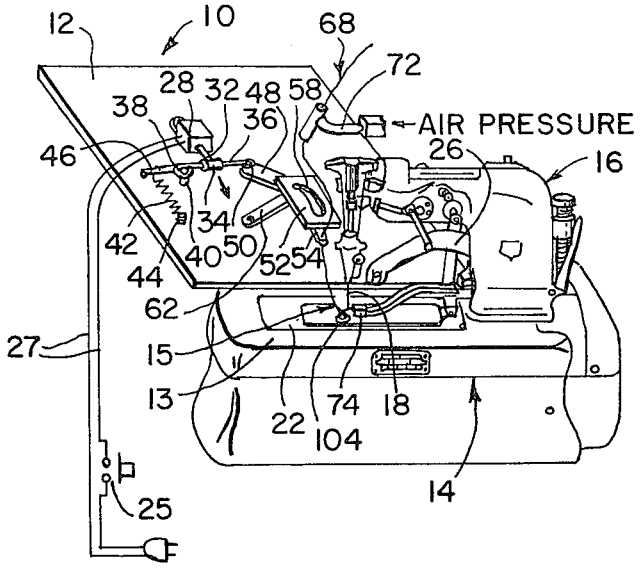
FIG. 1 is a front pictorial presentation of the belt loop forming attachment of the present invention in conjunction with a sewing machine.
Figure 2:
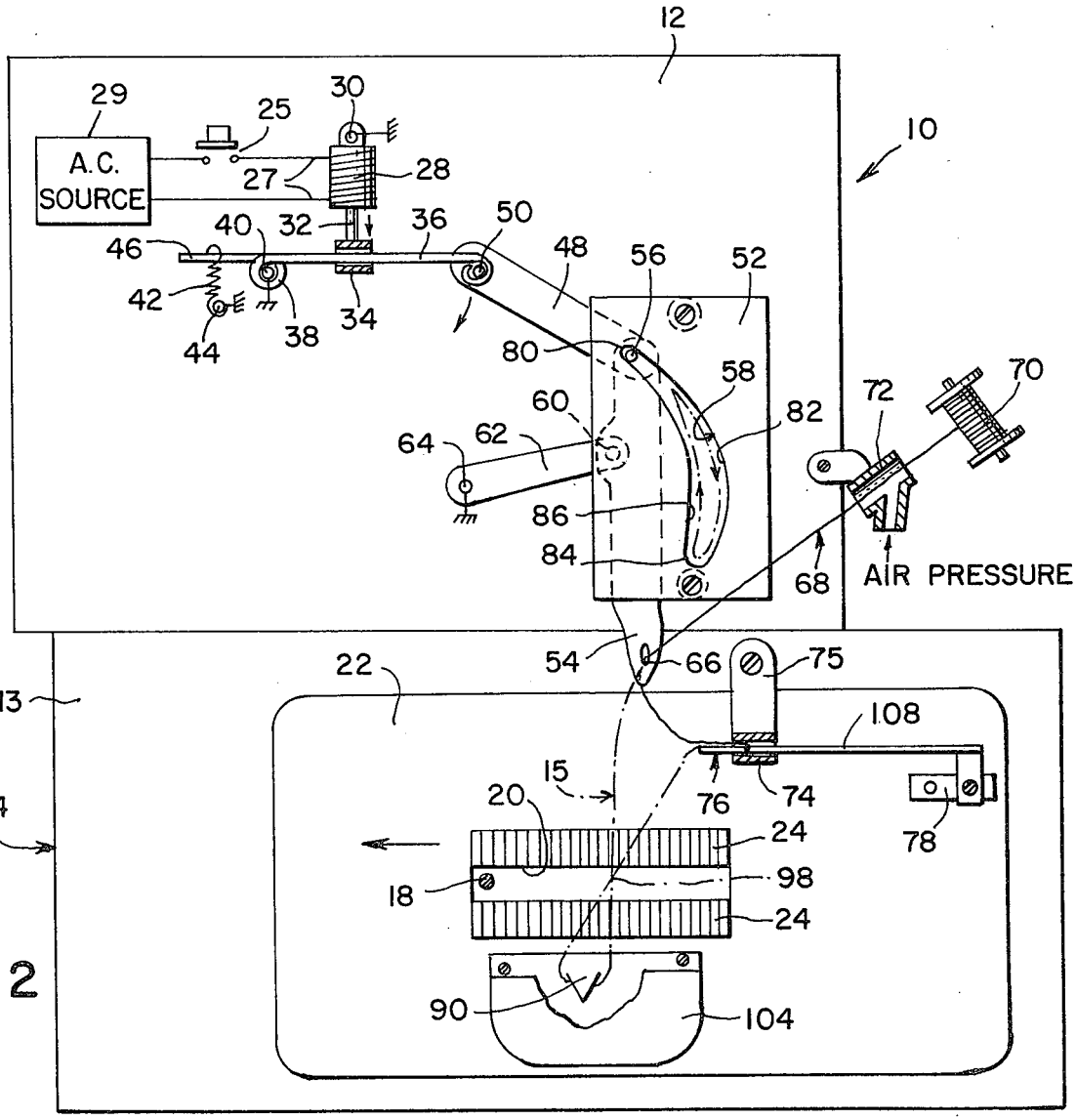
FIG. 2 is a detailed top view of the belt loop forming attachment of the present invention in conjunction with the bed of the sewing machine in FIG. 1 with its parts positioned in an initial stage of loop formation.
Figure 5:
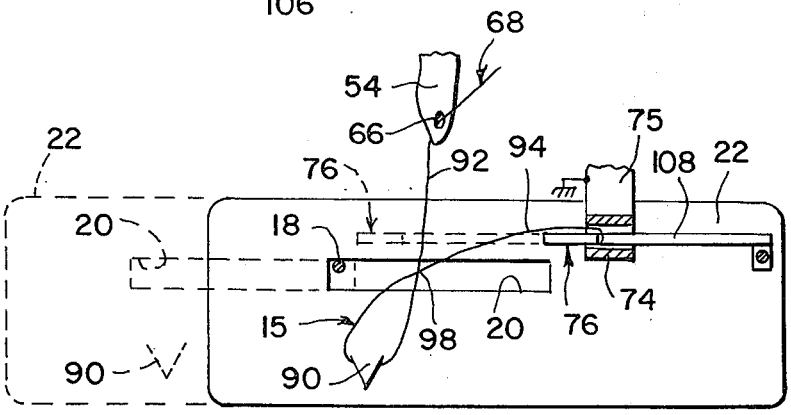
FIG. 5 is a detailed view of the thread loop in FIG. 4 indicating opposite extreme positions of parts of the sewing machine which move during its sewing cycle.

Referring to FIGS. 1, 2 and 5 of the drawing, a portion of the belt loop forming attachment 10 of the present invention is mounted on a fixed horizontal plate 12 resting on an edge of the fixed peripheral portion 13 of the horizontal bed 14 of a sewing machine 16, and is adapted to form a horizontal thread loop 15 on the bed. The sewing machine 16 is generally of the button hole sewing type and includes a vertically reciprocating needle 18 positioned over an elongated needle receiving slot or throat 20 in a sliding plate 22 forming the center of the bed of the machine. The plate 22 includes treads 24 for gripping a garment work piece on the bed of the machine in cooperation with the usual sliding presser foot (not shown) to carry the garment for movement with the plate. As illustrated in FIG. 5, plate 22 first moves forward, along the direction of elongation of the slot 20, to the forward extreme position thereof shown in phantom, and then returns to its initial position in a rearward movement. While the forementioned forward and rearward movements normally follow offset paths in a button hole type sewing machine to produce a rectangular sewing cycle, for the purposes of the present invention, the sewing machine 16 is adjusted to bring these paths into coincidence and the usual knife carried by the arm 26 of the machine for slitting between the paths is omitted.

The portion of attachment 10 on plate 12 comprises a solenoid 28 pivotally mounted on a vertical pin 30 carried by plate 12. The solenoid is energizeable via a momentary contact switch 25 in series with a line cord 27 for connection to an A.C. source 29, such as a wall outlet. Switch 25 may be positioned to be actuated by the knee of the operator. The stroking armature 32 of solenoid 28 terminates in a tubular sleeve 34 mounted slideably about a rod 36 which is bent into a loop at 38 for a rotatable mounting about a vertical pin 40 carried by plate 12. As a result, the rod 36 rotates clockwise about pin 40 in response to an outward stroke of solenoid armature 32. A spring 42 is stretched between a pin 44 carried by plate 12 and an extension 46 of rod 36 beyond pin 40 to urge the rod 36 to rotate counterclockwise and thereby return the armature 32 to its position prior to energization of solenoid 28.

The end of rod 36 remote from extension 46 is pivotally mounted to one end of a link 48 at 50. The other end of link 48 passes under a plate 52 supported vertically spaced above plate 12 to permit movement of link 48 thereunder. At that point, the other end of link 48 is connected pivotally to one end of a link 54 with a pin 56 which projects upwards into an arcuate teardrop shaped camming slot 58 in plate 52. Further, at a point 60 intermediate the length of link 54 the end of a link 62 is pivoted to plate 12 at 64. Also, the end of link 54 remote from pin 56 projects from plate 12 in the direction of needle 18 and has a thread guiding eye 66 formed therein.

A thread 68 for forming loop 15 is directed from a spool 70 through an air drag type thread tensioning device 72 and then downward through eye 66. The free end of the thread 68 is then pinched initially between a fixed sleeve or guide 74 mounted via an ear 75 to the fixed portion 13 of the machine bed and a blade 76 is carried by sliding plate 22 for movement into and out of the sleeve.

Figure 3:
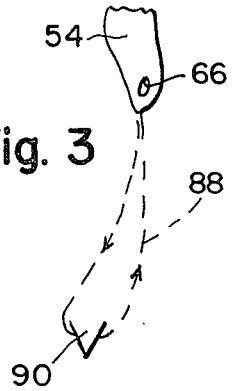
FIG. 3 is a fragmentary top view of a moveable portion of the belt loop forming apparatus indicating the path taken by its movement in forming a loop.

The pin 56 is normally positioned at a narrow extreme 80 of slot 58 remote from needle 18. In response to brief energization of solenoid 28, pin 56 moves along one side 82 of slot 58 to a broad extreme 84 of the slot nearest needle 18. Then due to the urging of return spring 42, the pin 56 moves back to extreme 80 along the other side 86 of slot 58. At the same time, the eye 66 follows a teardrop shaped contour 88, shown in FIG. 3, crossing over the needle receiving slot 20, and about frontwardly inclined upstanding prong 90 mounted on sliding plate 22 on the opposite side of the slot 20. Thus, the thread 68 is hooked about prong 90 to form thread loop 15. Consequently, the portion of loop 15 hooked about prong 90 is carried for movement with plate 22 and slot 20 during the sewing cycle of machine 16 to carry the loop under needle 18.

Figure 4:
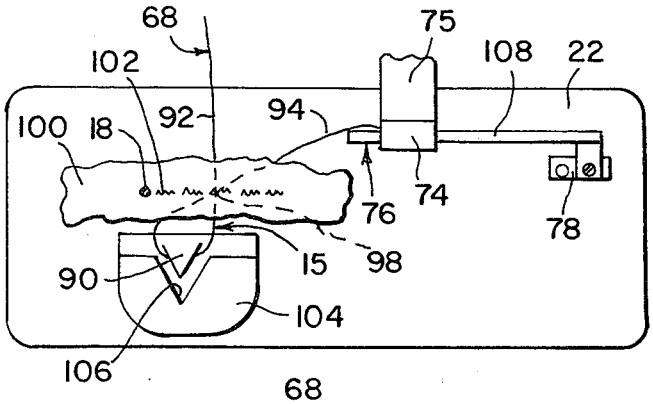
FIG. 4 is a top view of the bed of the sewing machine in FIG. 1 in conjunction with a garment having a thread loop fastened thereon.

The eye 66 moves about the prong 90 in a manner for the loop 15 to have two generally straight segments 92 and 94 as shown in FIGS. 2, 4 and 5. Segment 92 is directed from eye 66 to prong 90 and segment 94 is directed from prong 90 to sleeve 74 where the free end of the segment 94 is pinched. Segments 92 and 94 cross at a point 98 proximate to the center of slot 20.

With the loop 15 formed on bed 14, a garment 100, as shown in FIG. 4, is placed on top of the loop, front side down, and the sewing machine 16 is operated to go through its sewing cycle to produce the stitching 102 securing the loop 15 to the garment. To prevent prong 90 from ripping garment 100, a sheet metal guard 104 is mounted over the prong. A V-shaped slot 106 is provided in the guard to enable the loop 15 to be removed with garment 100 after the sewing is completed.

Figure 6:
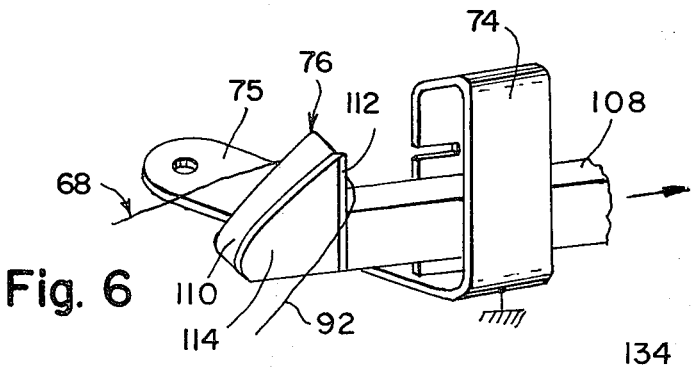
FIG. 6 is a detailed pictorial presentation of a portion of the belt loop forming attachment in FIG. 5.

As illustrated in FIGS. 2, 5 and 6, the blade 76 forms the head of an arm 108 translatable through sleeve or guide 74 and carried by plate 22 via a presser foot mounting boss 78. Blade 76 has a rearwardly inclined front edge 110 and a sharpened generally vertical rear edge 112 formed by a knife 114 secured to the side of blade 76. During the sewing cycle of machine 16, the blade 76 travels first forwardly and then rearwardly in the same manner as plate 22 and slot 20, shown in FIG. 5.

When starting its movement, the blade 76 leaves sleeve 74, releasing the free end of segment 94. As the blade 76 passes segment 92, the segment rides up front edge 110 and onto arm 108. Thereafter, upon the return of blade 76 to its initial position, segment 92 is stretched toward sleeve 74 as shown in FIG. 5. Upon blade edge 112 encountering sleeve 74, the thread segment 92 is sheared by blade edge 112 and the resultant free end of thread 68 emanating from eye 66 is held between the blade 76 and the sleeve as shown in FIG. 2, awaiting the solenoid 28 to be actuated to form a new loop 15.

Figure 7:
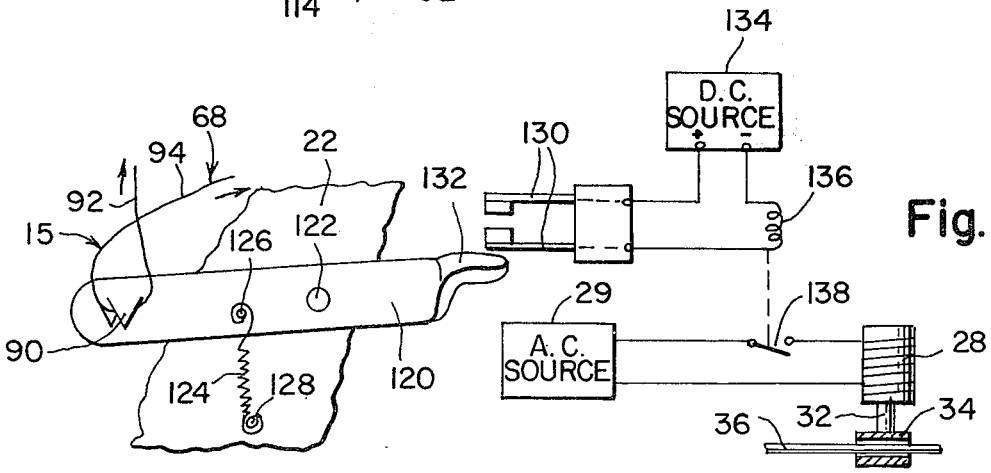
FIG. 7 is a partially schematic top view of a portion of the belt loop forming attachment according to an alternate embodiment.

In order to automatically energize solenoid 28 upon loop 15 being removed from prong 90 with garment 100, the alternate embodiment of FIG. 7 may be utilized. Therein, prong 90 is carried by lever 120 near one end of the lever. The lever is mounted about a vertical pin 122 carried by plate 22 to enable horizontal swinging movement of the lever. The tension of loop 15 exerts a force on prong 90 for rotating lever 120 slightly clockwise. A spring 124 is attached at one end 126 to lever 120 and the other end 128 is secured to the plate 22. Consequently, the spring 124 tends to rock lever 120 counterclockwise in the absence of loop 15 on prong 90. Normally separated microswitch contact reeds 130 are positioned for cooperation with a tab 132 formed on lever 120. The reeds 130 are adapted to contact each other upon the lever being rocked counterclockwise by spring 124 after the removal of loop 15. Reeds 130 are positioned to complete a series circuit between a low voltage D.C. source 134, such as 18 volts, and a D.C. relay coil 136. The associated normally open contact 138 controlled by coil 136 is in series between A.C. source 29 and solenoid 28. Therefore, when loop 15 is removed from prong 90, the solenoid 28 is automatically energized to form a new loop. To provide adequate time to remove garment 100 from the bed 14, the relay formed by coil 136 and contact 138 may be of the time delay type to provide a delay on the order of two seconds between the removal of loop 15 from prong 90 and the energization of solenoid 28.

Having described the preferred embodiments of the present invention in specific detail, it should be noted that numerous modifications, additions and omissions in the details thereof are possible within the intended spirit and scope of the invention claimed herein.

What is claimed is:

1. In sewing machine apparatus having a generally vertically reciprocable sewing needle positioned above an elongated throat in a sliding generally horizontal portion of a bed of the sewing machine apparatus, said sliding portion adapted to carry a garment in an elongated sewing path by said needle. the attachment for forming a generally horizontal thread loop on the bed of the sewing machine apparatus, said thread loop intersecting said throat to enable the needle of the sewing machine apparatus to sew the loop on a garment positioned over the thread loop, said attachment adapted to cooperate with a source of thread for said loop, said attachment comprising: a prong mounted on the sliding portion of the bed of the sewing machine on one side of said throat; a linkage mounted proximate the bed of the sewing machine apparatus on the other side of said throat, said linkage including a horizontally moveable arm having an eye at one end nearest the throat adapted to receive thread from said source therethrough; means on said other side of said throat for holding a free end of said thread after passage through said eye; said eye having an initial position on said other side of said throat, said linkage being actuatable for moving said eye across said throat, around a side of the prong facing away from the throat, and then returning across the throat to its initial position for forming said thread loop supported at its point greatest curvature on said prong, and motor means for actuating said linkage.

2. The attachment of claim 1, wherein said linkage is configured to move said eye along a teardrop shaped generally horizontal contour passing around said prong in a direction relative to the location of said holding means for forming said loop having a first generally straight segment radiating from said eye to said prong and a second generally straight segment radiating from said prong to said holding means, said first and second segments crossing each other proximate to said throat.

3. The attachment of claim 2, wherein said sewing machine apparatus is adapted to move the sliding portion of its bed along the sewing path in one direction and then back generally along the sewing path in the opposite direction; said holding means comprising a blade carried for movement with said sliding portion of said bed; a generally horizontal guide about said blade, said guide being carried by a fixed portion of said bed; said blade being moveable into and out of said guide and being configured for pinching said free end of said thread between said blade and said guide, said blade having a rearwardly inclined front edge adapted to deflect said second loop segment upward to enable said blade to pass under said second during its forward travel; said blade having a generally vertical sharpened rear edge for carrying said second segment to said guide and for cutting said second segment.

4. The attachment of claim 3, wherein said motor means is electrically energizeable and further comprising a lever pivotally mounted on said sliding protion of said bed on said one side of said throat for horizontal swinging movement, said prong being carried proximate one end of said lever in a manner for said lever to be swung in one direction of rotation by the tension of said loop prior to the cutting of said segment; spring means for urging said lever to rotate in an opposite direction of rotation after said second segment is cut; and microswitch means responsive to movement of said lever in said opposite direction for energizing said motor means.

* * * * *